US006305389B1

(12) United States Patent
Bakken

(10) Patent No.: US 6,305,389 B1
(45) Date of Patent: Oct. 23, 2001

(54) MASCARA APPLICATION GUARD

(76) Inventor: Virginia Bakken, 2843 Keebler, Maryville, IL (US) 62062

( * ) Notice: Subject to any disclaimer, the term of this patent is extended or adjusted under 35 U.S.C. 154(b) by 0 days.

(21) Appl. No.: 09/757,103

(22) Filed: Jan. 10, 2001

(51) Int. Cl.[7] ..... A45D 40/30; A45D 29/00
(52) U.S. Cl. ..... 132/319; 132/285; 132/216
(58) Field of Search ..... 132/319, 285, 132/216, 217; 2/174, 9

(56) References Cited

U.S. PATENT DOCUMENTS

| | | | | |
|---|---|---|---|---|
| D. 255,606 | | 6/1980 | Garcia | D28/9 |
| D. 341,001 | | 11/1993 | Pantages | D28/7 |
| 1,850,540 | | 3/1932 | Erickson | 132/216 |
| 1,873,923 | | 8/1932 | Bohner | 132/216 |
| 1,974,825 | | 9/1934 | Lovie | 132/216 |
| 2,260,614 | * | 10/1941 | Freitas | 132/216 |
| 3,884,232 | * | 5/1975 | Braun | 128/260 |
| 5,016,658 | * | 5/1991 | Green | 132/216 |
| 5,178,170 | * | 1/1993 | Kassai | 132/319 |
| 5,890,499 | | 4/1999 | Fuentes | 132/319 |

* cited by examiner

*Primary Examiner*—John J. Wilson
*Assistant Examiner*—Robyn Kieu Doan
(74) *Attorney, Agent, or Firm*—Don W. Weber

(57) ABSTRACT

A Mascara Application Guard made of a hypoallergenic material such as silicone is presented. It has an irregular shape, and is about 109 mm long and about 52 mm wide. The guard has different sized curvatures to fit the different size of eyes found in human beings. At one end of the guard, a curvature of approximately 25 mm is used for persons having small sized eye sockets. At the opposite end of the guard a medium size curvature of approximately 32 mm is available for persons having medium sized eye sockets. A very large curvature is located perpendicular to the medium sized curvature. This larger curvature is approximately 34 mm in radius. Each of the three curvatures has a raised edge in order to facilitate its use. The guard is used by placing it underneath the lower eyelashes or on top of the upper eyelashes. Mascara may then be applied to the eyelashes. The guard prevents the mascara from also being deposited on the skin underneath the guard.

6 Claims, 4 Drawing Sheets

MASCARA APPLICATION GUARD

BACKGROUND OF THE INVENTION

This invention relates to the field of cosmetics. More particularly, a Mascara Application Guard is presented which enables the user to cover a portion of the eye and eyeliner when mascara is being applied.

In the application of cosmetics to the face, mascara is often used on the upper and lower eyelashes. However, this mascara is colored, often black. While applying mascara, it often becomes difficult to deposit the mascara only to the eyelashes where it is desired, and not to other places around the eye. A number of mascara shields have been devised in order to aid the person applying the mascara or other cosmetics.

One example of an ergonomic mascara shield is the 1999 patent issued to Fuentes, U.S. Pat. No. 5,890,499. This mascara shield was ergonomically designed to provide a barrier over the upper and lower eyelashes of a user's face to prevent smearing during the application of mascara. The Fuentes device has some limited application, although it was not apparently designed with the variations of palpebral fissure spaces in mind.

Another similar device, an eyelid guard, was patented in 1932 by S. E. Bohner. In this patent, U.S. Pat. No. 1,873,928, an elongated stick was provided having an eyelid contour. It was used in applications similar to the instant device. However, Fuentes and Bohner did have certain drawbacks, particularly that they were not specifically designed for the different shape of eyes.

It is an object of this invention to provide a mascara shield to prevent the smearing of mascara when that is being applied to the eyelashes. It is another object of this invention to provide a uniquely designed mascara shield that has multiple eye contours for the various size eyes of different human beings. It is a still further object of this invention to provide a multiple sized mascara shield that may be utilized by a number of different individuals to prevent the smearing of mascara. Other and further objects of this invention will become obvious upon reading the below described Specification.

BRIEF DESCRIPTION OF THE DEVICE

A small, ergonomically designed, irregularly shaped mascara application guard is presented. The guard is approximately 109 mm in length and is about 52 mm at its widest part. The guard is designed to fit the different sizes of palpebral fissures (eye sockets) found in most females. Since the length of the palpebral fissure differs in females, three separate eye contours are built into the device. Two of the eye contours are at one end of the device and a third is at the second end. Each of the three eye contours is accompanied by a bulge or eye pocket. The appropriate eye contour and pocket are selected for the size of a user's eyes. The device is then slipped under the lower eyelash. With this guard in place, the mascara can be applied to the eyelash. A similar method of use of the product occurs for the upper eyelashes. The device is made of a hypoallergenic material such as silicone. A raised ridge is located around the edge of each eye contour to further help the user to separate the eyelashes from the eyelid skin.

BRIEF DESCRIPTION OF THE DRAWING FIGURES

FIG. 6 is taken along lines 6—6 of FIG. 5.

DETAILED DESCRIPTION OF THE DEVICE

Figure 1:
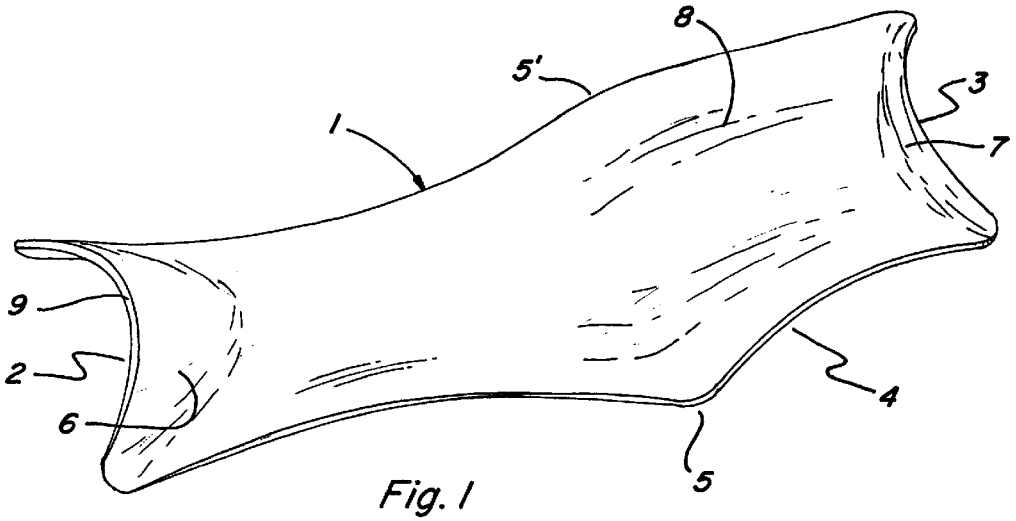
FIG. 1 is a perspective view of one embodiment of the device showing the eye contours and eye pockets and general shape of the device.

In the cosmetic field, it is often desirable to put mascara on the eyelashes. However, one drawback is that the mascara can often appear in areas in which it is not wanted. The instant device has been devised in order to remedy that problem. The device is used in conjunction with the application of cosmetics and protects areas of the eye from the unwanted application of mascara. A number of these devices have already been marketed. However, the instant invention discloses at least three differing eye contours and eye pockets designed to accommodate the different size of eyes found in human beings.

In the preparation of this invention, experimental data has revealed that the average horizontal width of the palpebral fissure (eye socket) in adults is approximately 28 to 30 mm. This horizontal width varies with the sex, race, and certain rare pathological conditions of the human being. Furthermore, this horizontal width varies depending upon age. Between the ages of 12 and 25 the eye socket increases by 3 mm. It then remains stable between ages 25 and 35. However, between the ages of 35 and 85, it shortens back again by approximately 2.5 mm on the average.

The horizontal palpebral fissure width in black females tends to be larger by 1 to 2 mm depending upon the age bracket. There is no literature or experimental data regarding other races. Even though there are some rare conditions that affect the palpebral fissure width, this occurrence is so small that any device made for the general population would not be able to accommodate these rare conditions.

Upon gathering the appropriate information, Applicant has found that elderly or young white females could be assumed to have an average horizontal palpebral fissure of approximately 26 mm. A 30 year old black female could be assumed to have an average horizontal palpebral fissure length of 31 mm. Thus, an optimum radius for a mascara guard would be between 26 and 31 mm. These general measurements and considerations were all taken into account in creating the following mascara application guard.

In addition to the normal curvature necessary for the eyelashes, it would also be helpful if the mascara guard had a bulge so as to hold the guard away from the eyeball. Further, since the eye is a sensitive area, it would be important to have the material used in the construction of the mascara guard to be hypoallergenic to the skin and to have rounded edges so as not to injure the eye even when the guard is mishandled.

One embodiment of the instant mascara guard is shown in FIG. 1. The guard has an irregular shape as shown in Drawing FIGS. 1 through 3. The mascara guard is approximately 109 mm in length and is approximately 52 mm shoulder to shoulder at its widest part. In order to accommodate the varying width of palpebral fissures (eye sockets), three separate eye contours are provided.

Figure 2:
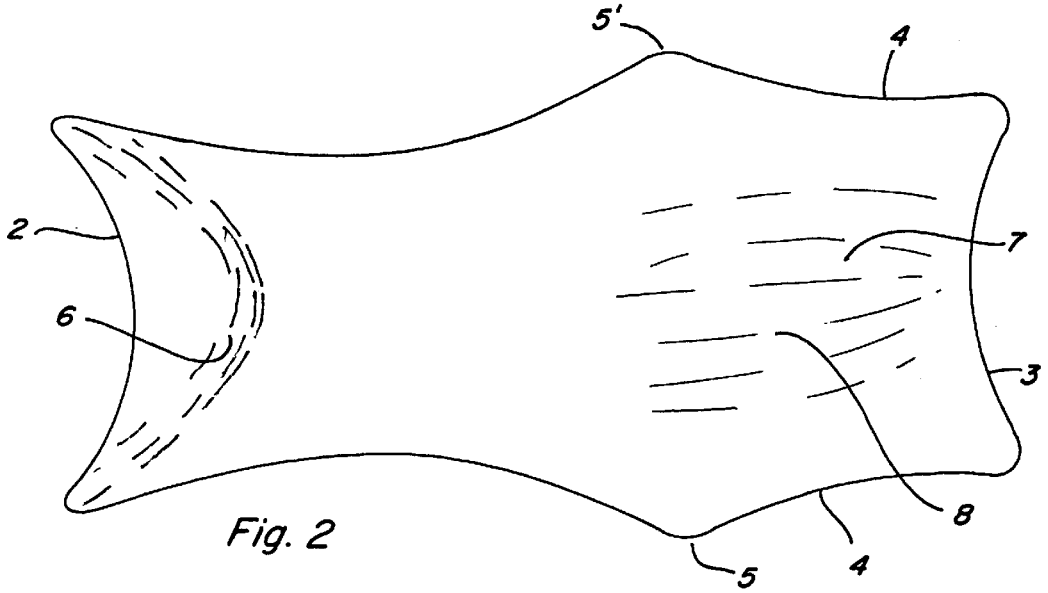
FIG. 2 is a plan view of the device shown in FIG. 1.

The horizontal guard 1 as shown in FIG. 1, has three separate eye contours to accommodate the different sizes of eye sockets. A first small eye contour 2 has a generally curved shape as shown in FIGS. 1 and 2. The small eye contour 2 has the smallest radius of curvature. In the preferred embodiment, this radius of curvature is approximately 25 mm. In practice, it has been found that this 25 mm could vary by as much as ±15 percent while still keeping within the spirit and disclosure of this invention. The small eye contour 2 is accompanied by a concave small eye pocket or bulge 6. This pocket is raised as shown in FIGS. 1, 2 and 3.

A medium eye contour 3, as shown in FIGS. 1 and 2, is also available for persons having slightly larger eye sockets. The radius of curvature of the medium eye contour 3 is approximately 32 mm. The medium eye contour 3 is also accompanied by a concave medium eye pocket or bulge 7. The eye contours and eye pockets are similar in physical characteristics but vary slightly according to the dimensions disclosed. Again, the medium eye contour 3 radius could vary by as much as ±15 percent while still keeping within the spirit and disclosure of this invention. The small eye contour 2 is located at one end edge of the guard 1 while the medium eye contour 2 is located at the opposite end edge.

A large eye contour 4 is also located at the second or opposite end of the guard. However, the large eye contour 4 is located on the top and bottom length edges of the device, as shown in FIGS. 1 and 2. The large eye contour 4 has a large eye contour radius of curvature of approximately 34 mm. This larger radius accommodates persons having larger eye sockets. The large eye contour is accompanied by a concave large eye pocket or bulge 8. The large eye contour 4 radius could be ±15 percent while still within the spirit of this invention.

Figure 3:
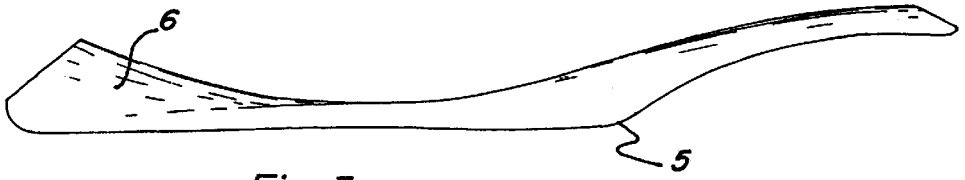
FIG. 3 is a side view of the device shown in FIG. 1

The geometry of the eye contours and eye pockets described above results in an irregularly shaped mascara guard as shown in Drawing FIGS. 1 through 3. Each of the small, medium and large eye contours (2, 3 and 4) is accompanied by a small, medium and large concave raised eye pocket (6, 7 and 8), respectively. This results in the irregularly shaped mascara guard shown in the Drawing Figures.

The mascara guard itself has a small thickness 9, as best shown in FIG. 1. The thickness of the entire device is approximately 1 mm. The device is made of a hypoallergenic material, such as silicone. It has rounded edges, as shown in the, Drawing Figures, so as to insure that one will not injure one's eye in using the device. While the device has an irregular perimeter, the maximum width of the device across the shoulder area 5–5' is approximately 52 mm. Again, these dimensions, particularly the overall length and overall width of the device, are meant for illustration only and are not meant as a limitation. The device could be somewhat longer, somewhat shorter, somewhat narrower or somewhat wider while still keeping within the spirit of this disclosure.

The average length of an adult female's eyelash is 7 mm on the lower lid and 11 mm on the upper lid according to experimentation. Therefore, an upper and lower flange that is approximately 1 mm in height could be added to the device in order to increase better separation between the eyelashes and the other parts of the eye to which the mascara is to be applied.

Figure 4:
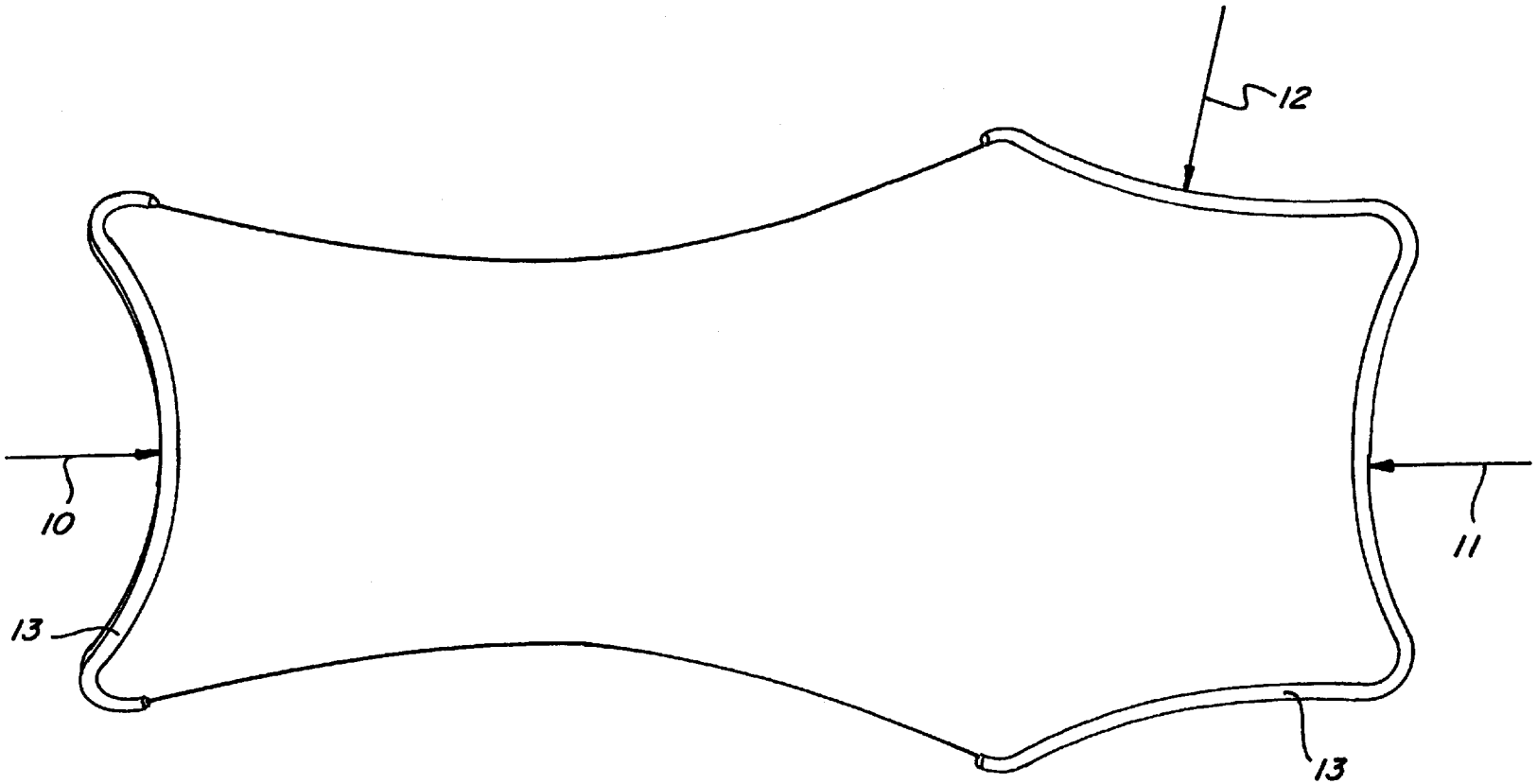
FIG. 4 is a plan view of a second embodiment of the device, shown with the eye contour flange around each eye contour.
Figures 5, 6:
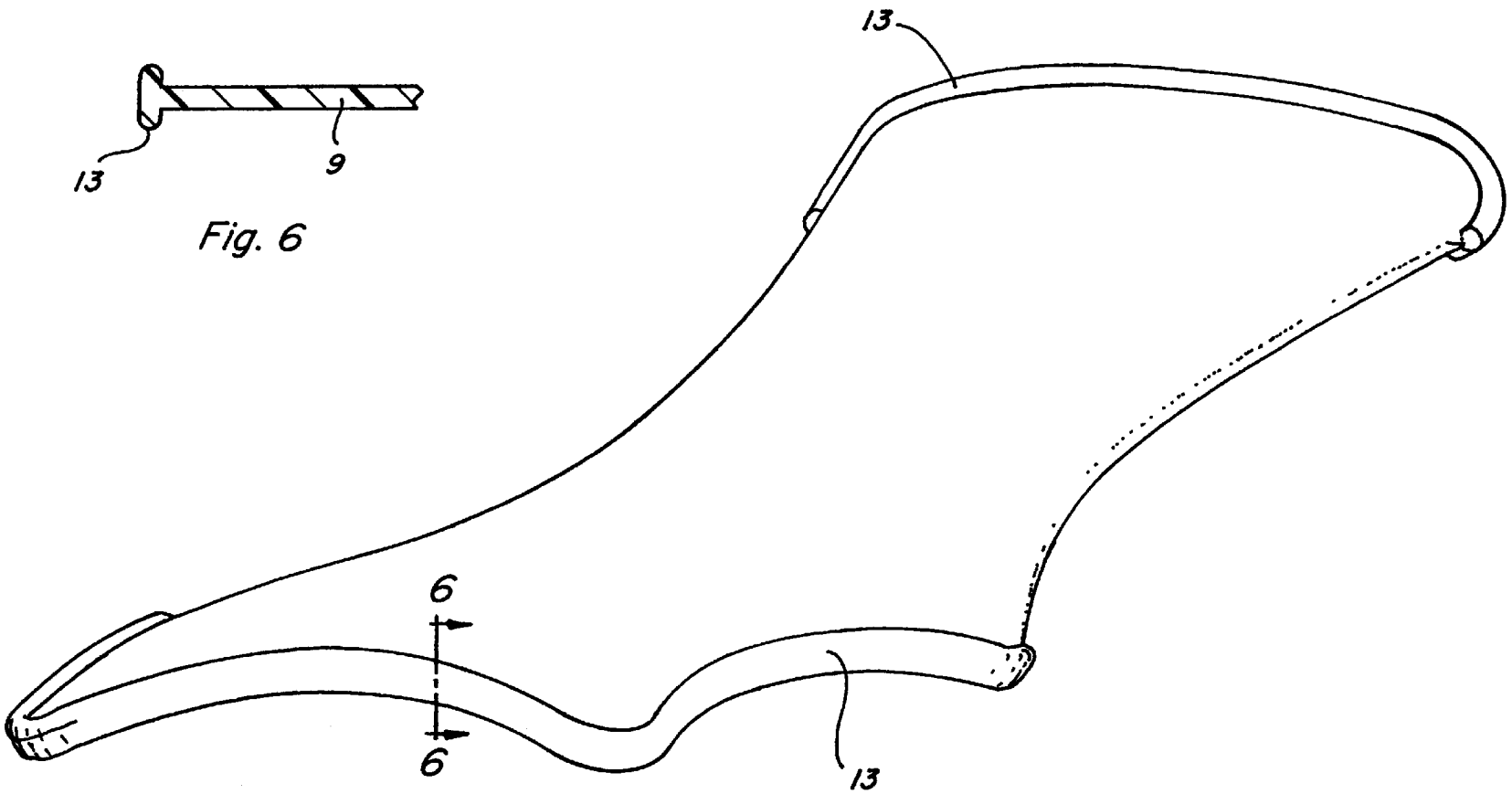
FIG. 5 is a perspective view of the second embodiment of the device shown in FIG. 4.
FIG. 6 is a side cutaway view of the device shown in FIG. 5, depicting the flange.

Another embodiment of this device is shown in FIGS. 4, 5 and 6. While the general contours of the second embodiment are the same, an integral eye contour flange has been added. This eye contour flange 13 is best shown in FIGS. 4, 5 and 6. The eye contour flange adds a thickness of approximately 1 mm to the edge of the upper surface and 1 mm to the edge of the lower surface.

This eye contour flange 13 is shown in FIG. 6 cross section. The flange 13 is integral with the guard 1, the piece being molded as one integral unit. The flange 13 is located around the edge of the small, medium, and large eye contours as shown on FIGS. 4 and 5. As can be seen from FIG. 6, the thickness of the body 9, which is approximately 1 mm, is raised at the eye contour flange 13 approximately 1 mm above and 1 mm below the upper and lower surfaces of the body of the guard 1, respectively.

Turning now to FIG. 4, it can be seen that a small eye contour radius 10 is located at one end of the guard. The medium 11 and large 12 eye contour radii are located at the second or opposite end of the guard 1. The medium eye contour radius 11 is located on the second or opposite side of the guard as shown on FIGS. 4 and 5. The large eye contour radius 12 is located on the top and bottom edges of the second end essentially perpendicular to the medium eye contour radius 11. As best shown in Drawing FIGS. 4 and 5, the eye contour flange 13 is located around the small, medium and large eye contours. The small, medium and large radii of the second embodiment are similar to the radii described above for the first embodiment shown in Drawing FIGS. 1 through 3. Radius 10 is approximately 25 mm; radius 11 is approximately 32 mm; radius 12 is approximately 34 mm.

As with the embodiment shown in FIG. 1, the eye contours of the second embodiment shown in FIGS. 4 and 5 also have corresponding small, medium and large raised eye pockets or bulges to create the ergonomically effective but irregular shape of the device as shown in the Drawing Figures. The second embodiment of the device has the same general overall dimensions, 109 mm in length and 52 mm in maximum width, as does the first embodiment.

Figure 7:
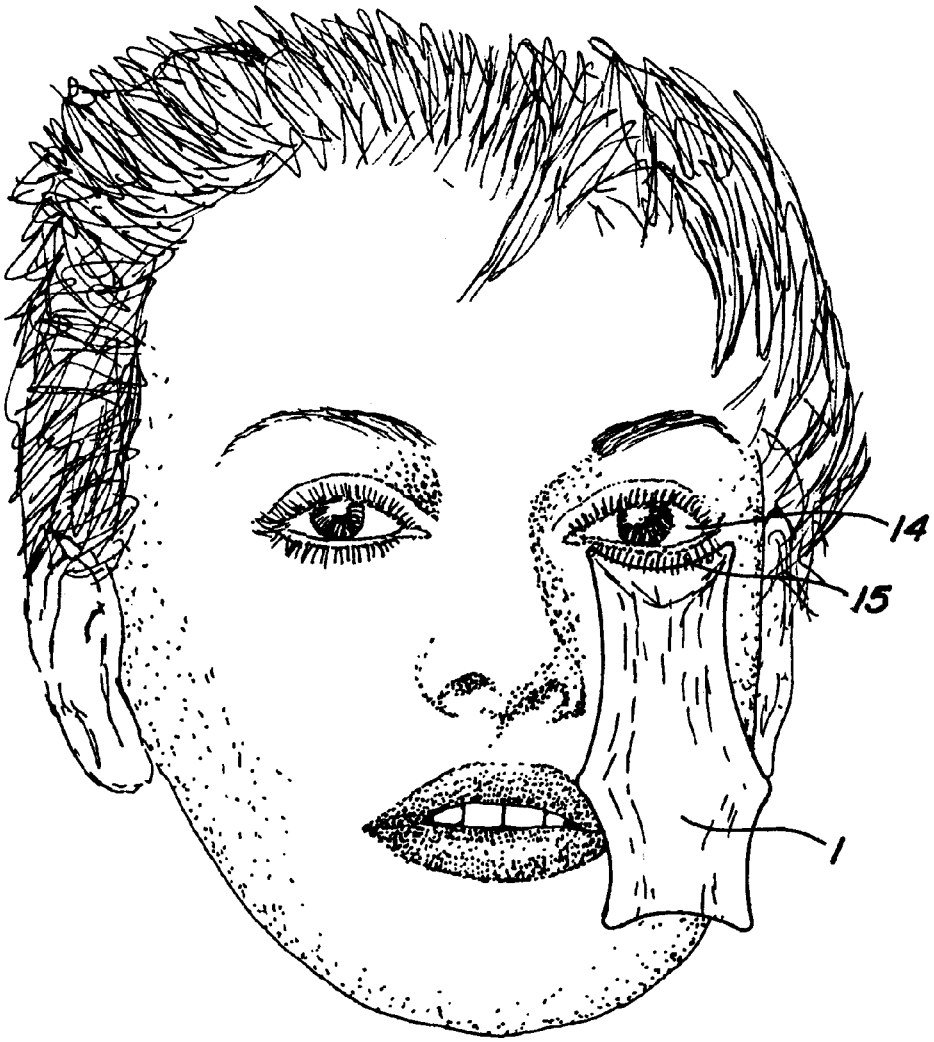
FIG. 7 is a view of the device as it would be used in application of the mascara.

Turning now to FIG. 7, one can easily see how the device is used in the application of mascara. One simply selects the correct eye contour, whether it is for a small eye, a medium eye, or a large eye. The device is then placed underneath the lower eyelashes, as shown. The mascara guard then keeps any mascara from being applied except to the eyelashes themselves. Since all of the corners of the guard are rounded, there is little or no danger in the device resulting in any injury or discomfort.

The dimensions of the small, medium and large eye contour radii have been reached after careful experimentation. The guard 1 is selected according to the general size of the eye socket 14. The guard is placed below the lower eyelashes 15 as shown in FIG. 7. Mascara can then be applied to the eyelashes without the problem of having the mascara also applied to the skin beneath. The guard is used on the upper eyelash in a similar manner. The guard prevents the mascara from being applied to the skin beneath the eyelashes.

Having fully described my invention, I claim:

1. A mascara guard, comprising:

(a) a thin, elongated, irregularly shaped body with a length generally greater than its width, said length terminating at first and second opposite end edges and having top and bottom length edges;

(b) a small eye contour located at the first end edge, wherein said small contour has a radius of curvature of 25 mm;

(c) a medium eye contour located at the second, opposite edge wherein said medium contour has a radius of curvature of 32 mm;

(d) a top and bottom large eye contour located at said second end, essentially perpendicular to said medium radius along said top and bottom length edges, respectively, wherein said large contours each have a radius of curvature of 34 mm;

wherein each of said small, medium and large eye contours have an accompanying concave small, medium and large raised eye pocket, respectively.

2. A mascara guard, as in claim 1, wherein said small eye contour radius is between 21.25 mm and 28.75 mm.

3. A mascara guard as in claim 1, wherein said medium eye contour radius is between 27.2 mm and 36.8 mm.

4. A mascara guard as in claim 1, wherein said large eye contour radius is between 28.9 mm and 39.1 mm.

5. A mascara guard as in claim 1, further comprising a flange located on the edge of said small, medium and large eye contours.

6. A mascara guard as in claim 5, wherein said flange is approximately 1 mm above and 1 mm below the upper and lower surfaces of said guard, respectively.

* * * * *